US011146041B2

(12) United States Patent
Shimada et al.

(10) Patent No.: US 11,146,041 B2
(45) Date of Patent: Oct. 12, 2021

(54) SPARK PLUG THAT HAS AN INSULATOR LESS LIKELY TO BE DAMAGED

(71) Applicant: NGK SPARK PLUG CO., LTD., Nagoya (JP)

(72) Inventors: Hiroki Shimada, Nagoya (JP); Haruki Yoshida, Nagoya (JP); Naoya Harata, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 17/275,054

(22) PCT Filed: Jun. 23, 2020

(86) PCT No.: PCT/JP2020/024544
§ 371 (c)(1),
(2) Date: Mar. 10, 2021

(87) PCT Pub. No.: WO2021/010102
PCT Pub. Date: Jan. 21, 2021

(65) Prior Publication Data

US 2021/0257816 A1 Aug. 19, 2021

(30) Foreign Application Priority Data

Jul. 18, 2019 (JP) ..... JP2019-132358

(51) Int. Cl.
*H01T 13/20* (2006.01)
*H01T 21/02* (2006.01)

(52) U.S. Cl.
CPC ..... *H01T 13/20* (2013.01); *H01T 21/02* (2013.01)

(58) Field of Classification Search
CPC ..... H01T 13/36; H01T 13/20; H01T 21/02; H01T 13/34; H01T 13/38; H01T 13/39; F02P 13/00; F23Q 7/001
See application file for complete search history.

(56) References Cited

U.S. PATENT DOCUMENTS 4,906,889 A * 3/1990 Dibert ..... H01T 13/32 313/126
7,382,085 B2 * 6/2008 Suzuki ..... H01T 13/32 313/118

(Continued)

FOREIGN PATENT DOCUMENTS

JP 2001-155546 A 6/2001
JP 2001-155839 A 6/2001
JP 2018-085323 A 5/2018

OTHER PUBLICATIONS

International Search Report from corresponding International Patent Application No. PCT/JP20/24544 dated Sep. 15, 2020.

*Primary Examiner* — Tracie Y Green
(74) *Attorney, Agent, or Firm* — Kusner & Jaffe

(57) ABSTRACT

An insulator for a spark plug including a first portion; a second portion located on the rear side of the first portion, an outer diameter F at a front end of the second portion being smaller than an outer diameter of the first portion; a third portion located on the front side of the first portion, an outer diameter D at a rear end of the third portion being smaller than the outer diameter of the first portion and the outer diameter F at the front end of the second portion; a first slope portion connecting the first portion and the second portion; and a second slope portion connecting the first portion and the third portion. A length A of the second slope portion and a length B of the first slope portion satisfy 2.0≤A/B≤3.9, and 0.50≤D/F≤0.88 is satisfied.

5 Claims, 7 Drawing Sheets

(56) References Cited

U.S. PATENT DOCUMENTS

| | | | | |
|---|---|---|---|---|
| 8,963,406 | B2 * | 2/2015 | Zheng | H01T 13/41<br>313/141 |
| 10,193,311 | B2 * | 1/2019 | Yokoyama | H01T 13/38 |
| 10,354,782 | B2 * | 7/2019 | Zheng | H01T 13/20 |
| 2001/0002096 | A1 | 5/2001 | Honda et al. | |
| 2001/0004184 | A1 | 6/2001 | Ito et al. | |
| 2018/0138665 | A1 | 5/2018 | Ishiguro et al. | |

* cited by examiner

SPARK PLUG THAT HAS AN INSULATOR LESS LIKELY TO BE DAMAGED

FIELD OF THE INVENTION

The present invention relates to a spark plug having a cylindrical insulator.

BACKGROUND OF THE INVENTION

In order that a cylindrical insulator used in a spark plug becomes less likely to be broken, Japanese Patent Application Laid-Open (kokai) No. 2001-155839 ("Patent Document 1") discloses a feature that a value obtained by dividing the thickness of a certain part of the insulator by the outer diameter of the part is set in a certain range.

However, there is room for improvement in the above feature.

SUMMARY OF THE INVENTION

The present invention has been made to meet a demand for improvement and an object of the present invention is to provide a spark plug in which an insulator can be less likely to be broken.

Means for Solving the Problem

To attain the above object, a spark plug of the present invention includes an insulator in which an axial hole extending along an axial line from a front side to a rear side is formed. The insulator includes: a cylindrical first portion; a cylindrical second portion located on the rear side of the first portion, an outer diameter F at a front end of the second portion being smaller than an outer diameter of the first portion; a cylindrical third portion located on the front side of the first portion, an outer diameter D at a rear end of the third portion being smaller than the outer diameter of the first portion and the outer diameter F at the front end of the second portion; a first slope portion connecting the first portion and the second portion, and having an outer diameter that reduces toward the rear side; and a second slope portion connecting the first portion and the third portion, and having an outer diameter that reduces toward the front side. A length A in an axial-line direction of the second slope portion and a length B in the axial-line direction of the first slope portion satisfy $2.0 \leq A/B \leq 3.9$, and $0.50 \leq D/F \leq 0.88$ is satisfied.

Advantageous Effects of the Invention

In the spark plug according to a first aspect, when a bending load is applied to the insulator, stress concentrates on the first slope portion and the second slope portion where the sectional shapes perpendicular to the axial line are changed, so that the first slope portion and the second slope portion are likely to become a start point of breakage. In particular, the outer diameter D at the rear end of the third portion contiguous to the second slope portion is smaller than the outer diameter F at the front end of the second portion contiguous to the first slope portion and the outer diameter of the first portion. Therefore, the second slope portion is likely to crack prior to the first slope portion. However, when $0.50 \leq D/F \leq 0.88$ is satisfied, the length A in the axial-line direction of the second slope portion and the length B in the axial-line direction of the first slope portion satisfy $2.0 \leq A/B \leq 3.9$. Thus, stress in the second slope portion which is likely to become a start point of breakage can be reduced. Therefore, the insulator can be less likely to be broken.

In the spark plug according to a second aspect, $0.50 \leq D/F \leq 0.58$ is satisfied. Thus, the second slope portion is reduced in strength and becomes likely to crack. However, since $2.0 \leq A/B \leq 3.9$ is satisfied, stress in the second slope portion is reduced and crack of the second slope portion can be significantly inhibited.

In the spark plug according to a third aspect, $2.2D + 7.8 \leq Z \leq 34$ and $4.5 \leq D \leq 8$ are satisfied, where Z is a total length of a length in the axial-line direction of the third portion and the length A in the axial-line direction of the second slope portion. In addition to the effect of claim 1 or 2, the insulator can be even less likely to be broken.

In the spark plug according to a fourth aspect, $24 \leq Z \leq 34$ is satisfied. Thus, in addition to the effect of claim 3, the insulator can be further less likely to be broken.

In the spark plug according to a fifth aspect, the nominal diameter of an external thread of the metal shell is not greater than 12 mm. Therefore, the insulator provided inside the metal shell is thin and likely to be broken. However, by applying the present invention, the insulator can be less likely to be broken.

DETAILED DESCRIPTION OF THE INVENTION

Figure 1:
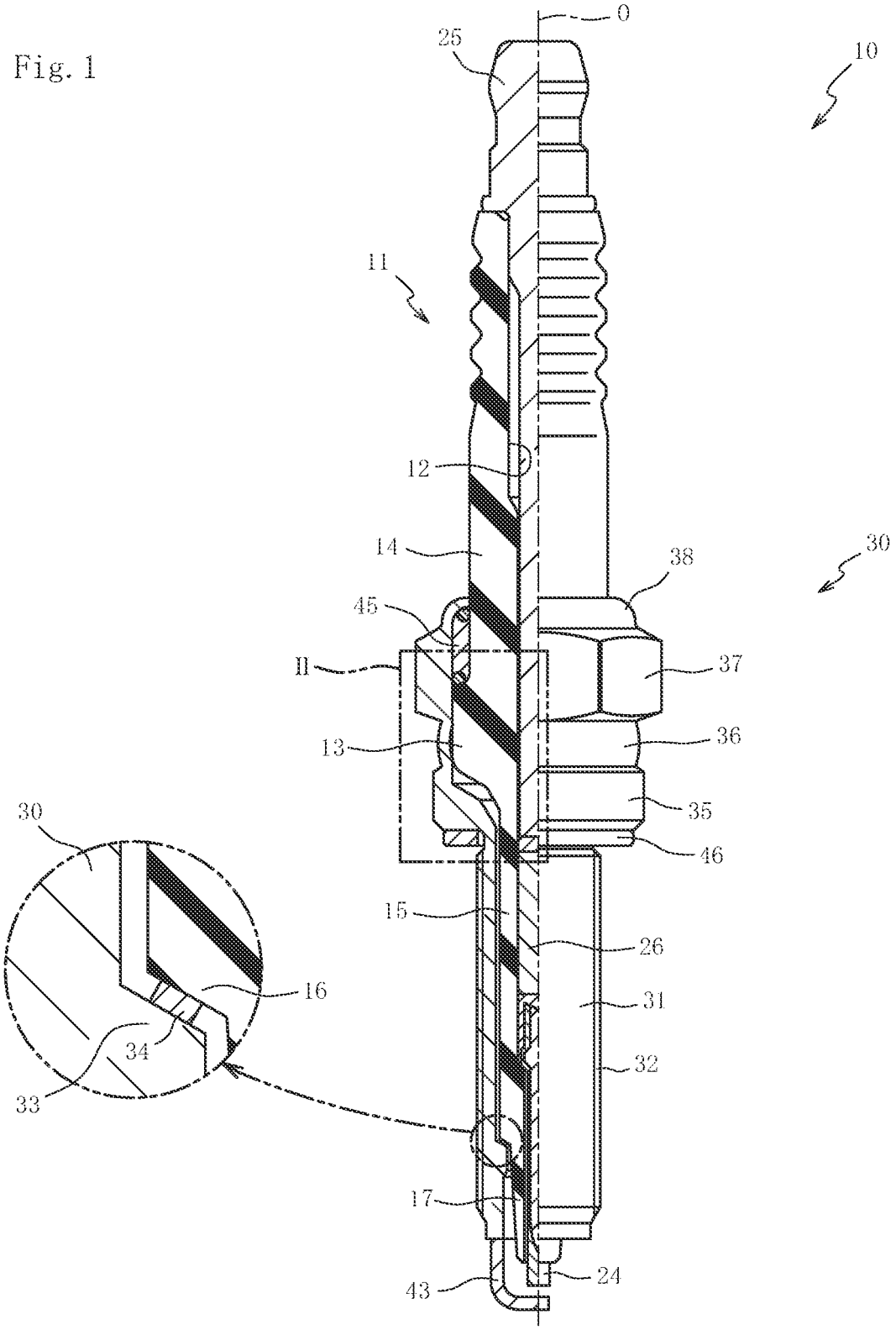
FIG. 1 is a half-sectional view of a spark plug according to the first embodiment.

Hereinafter, preferred embodiments of the present invention will be described with reference to the accompanying drawings. FIG. 1 is a half-sectional view of a spark plug 10 according to the first embodiment, with an axial line O as a boundary. In FIG. 1, the lower side on the drawing sheet is referred to as a front side of the spark plug 10, and the upper side on the drawing sheet is referred to as a rear side of the spark plug 10 (the same applies in FIG. 2 to FIG. 4). As shown in FIG. 1, the spark plug 10 includes an insulator 11 and a metal shell 30.

The insulator 11 is a cylindrical member made of a material such as alumina which is excellent in mechanical property and in insulation property under high temperature. The insulator 11 has an axial hole 12 penetrating therein and extending along the axial line O. The sectional shape of the axial hole 12 perpendicular to the axial line O is a circular shape. The insulator 11 includes a cylindrical first portion 13 located at the center in the axial-line direction, a cylindrical second portion 14 located on the rear side of the first portion 13, and a cylindrical third portion 15 located on the front side of the first portion 13. The second portion 14 has a corrugation **14*a*** on the rear side.

The outer diameter of the first portion 13 is constant over the entire length in the axial-line direction. The outer diameter of the second portion 14 is substantially constant over the entire length in the axial-line direction except for the corrugation 14*a*. The outer diameter of the third portion 15 is constant over the entire length in the axial-line direction. A conical diameter reducing portion 16 is provided on the front side of the third portion 15. The outer circumferential surface of the diameter reducing portion 16 has a diameter that reduces toward the front side. A front end portion 17 is formed contiguously to the front side of the diameter reducing portion 16.

A center electrode 24 is a bar-shaped electrode inserted in the front side of the axial hole 12 and held by the insulator 11 along the axial line O. The front end of the center electrode 24 protrudes to the front side with respect to the front end of the front end portion 17 of the insulator 11. The center electrode 24 is formed such that a core material having excellent thermal conductivity is embedded in a base material. The base material is formed from a metal material made of Ni or an alloy containing Ni as a main component, and the core material is formed from copper or an alloy containing copper as a main component. The core material may be omitted.

A metal terminal 25 is a bar-shaped member to which a high-voltage cable (not shown) is connected, and made of a conductive metal material (e.g., low-carbon steel). The front side of the metal terminal 25 is located in the axial hole 12 of the insulator 11. The metal terminal 25 is electrically connected to the center electrode 24 via a resistor 26 and the like provided in the axial hole 12. The rear end of the metal terminal 25 protrudes to the rear side with respect to the rear end of the insulator 11.

The metal shell 30 is a substantially cylindrical member made of a conductive metal material (e.g., low-carbon steel). The metal shell 30 is provided on the outer circumferential side of the insulator 11. The metal shell 30 has a cylindrical trunk portion 31 having an external thread 32 on the outer circumferential surface thereof, a seat portion 35 contiguous to the rear side of the trunk portion 31, a connection portion 36 contiguous to the rear side of the seat portion 35, a tool engagement portion 37 contiguous to the rear side of the connection portion 36, and a rear end portion 38 contiguous to the rear side of the tool engagement portion 37.

The external thread 32 is screwed to a screw hole of an engine (not shown). The trunk portion 31 has a ledge portion 33 formed over the entire circumference and protruding radially inward. The rear end surface of the ledge portion 33 has a diameter that reduces toward the front side. A packing 34 is interposed between the diameter reducing portion 16 of the insulator 11 and the ledge portion 33. The packing 34 is an annular plate member made of a metal material such as a soft steel plate softer than the metal material forming the metal shell 30.

The seat portion 35 is a part for closing a gap between the screw hole of the engine (not shown) and the external thread 32, and has a greater outer diameter than the trunk portion 31. The connection portion 36 is a part plastically deformed in a curved shape when the metal shell 30 is attached to the insulator 11. The tool engagement portion 37 is a part with which a tool such as a wrench is to be engaged when the external thread 32 is tightened to the screw hole of the engine. The rear end portion 38 is a part bent radially inward, and located on the rear side with respect to the first portion 13 of the insulator 11. A seal portion 45 filled with powder of talc or the like is provided between the first portion 13 and the rear end portion 38, over the entire circumference of the second portion 14 of the insulator 11.

The ledge portion 33 of the metal shell 30 is located on the front side with respect to the diameter reducing portion 16 of the insulator 11. When the metal shell 30 is attached to the insulator 11, a part from the ledge portion 33 to the rear end portion 38 of the metal shell 30 applies an axial-line-direction compressive load to the first portion 13 and the third portion 15 of the insulator 11 via the packing 34 and the seal portion 45. The ledge portion 33 engages with the diameter reducing portion 16 from the front side. As a result, the metal shell 30 holds the insulator 11.

A ground electrode 43 is a bar-shaped member made of metal (e.g., nickel-based alloy) and connected to the trunk portion 31 of the metal shell 30. The ground electrode 43 forms a spark gap between the ground electrode 43 and the center electrode 24. A gasket 46 is provided between the trunk portion 31 and the seat portion 35 of the metal shell 30. The gasket 46 improves airtightness between the screw hole of the engine (not shown) and the seat portion 35 when the metal shell 30 is attached to the engine.

Figure 2:
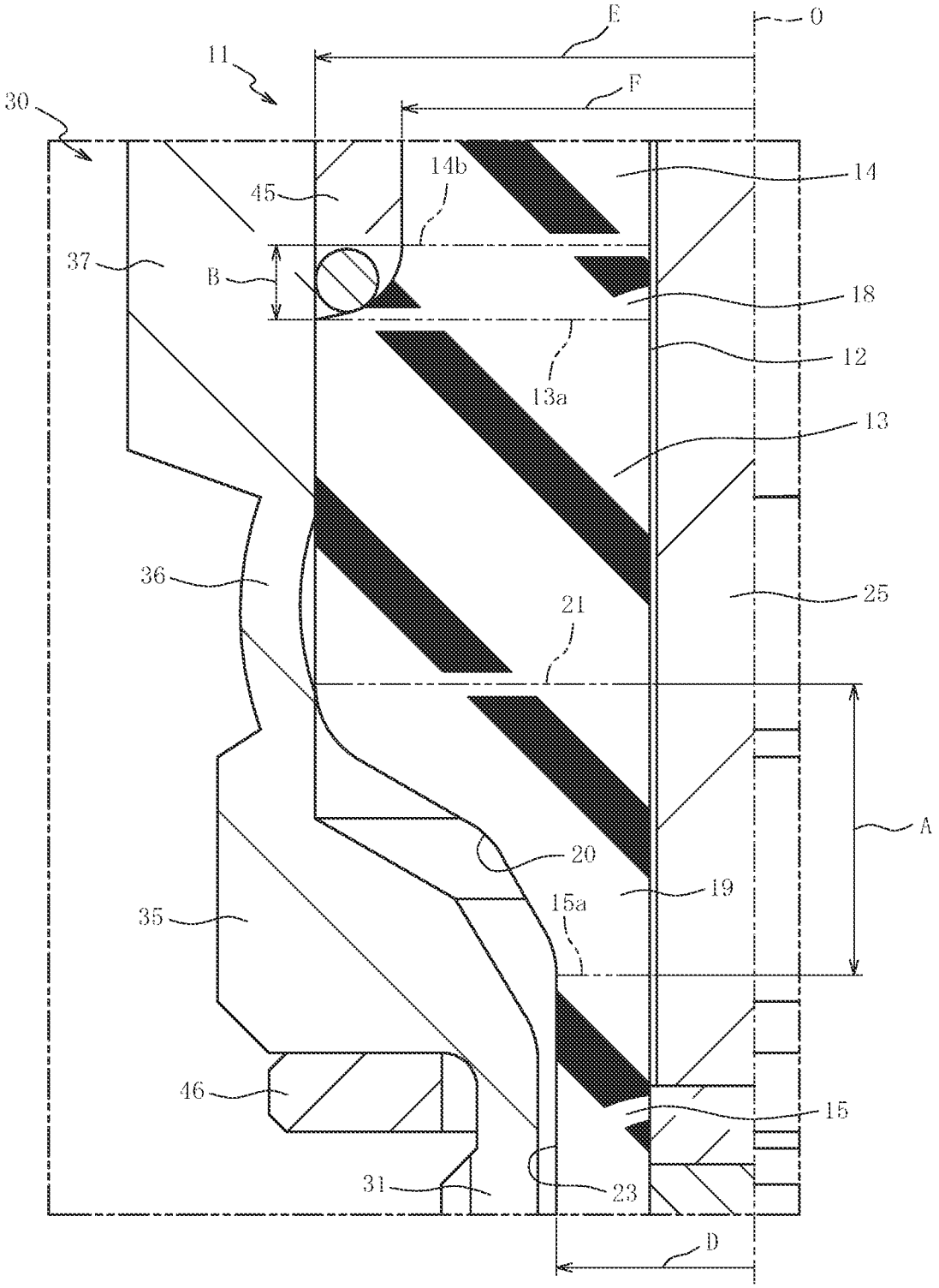
FIG. 2 is an enlarged sectional view of the spark plug at a part indicated by II in FIG. 1.

FIG. 2 is an enlarged sectional view including the axial line O of the spark plug 10 at a part indicated by II in FIG. 1. In the insulator 11, a first slope portion 18 having an outer diameter that reduces toward the rear side connects the first portion 13 and the second portion 14. The outer circumferential surface of the first slope portion 18 is convex toward the front side in a cross section including the axial line O. An outer diameter E of the first portion 13 is constant over the entire length in the axial-line direction, and therefore a part at which the outer diameter changes is a boundary between the first portion 13 and the first slope portion 18, i.e., a rear end 13*a* of the first portion 13. Near the front end 14*b* of the second portion 14, the outer diameter of the second portion 14 is constant, and therefore a part at which the outer diameter changes is a boundary between the second portion 14 and the first slope portion 18, i.e., a front end 14*b* of the second portion 14. The outer diameter of the boundary between the second portion 14 and the first slope portion 18 (the front end 14*b* of the second portion 14) is F. The front end 14*b* of the second portion 14 and the rear end 13*a* of the first portion 13 are located on the inner side of the tool engagement portion 37 of the metal shell 30.

In the insulator 11, a second slope portion 19 having an outer diameter that reduces toward the front side connects the first portion 13 and the third portion 15. In a cross section including the axial line O, an outer circumferential surface 20 of the second slope portion 19 is convex toward the front side, near the first portion 13, and is convex toward the rear side, near the third portion 15. A part at which the outer diameter changes is a boundary between the first portion 13 and the second slope portion 19. The outer diameter of the boundary between the first portion 13 and the second slope portion 19, i.e., a rear end 21 of the second slope portion 19, is E. An outer diameter D of the third portion 15 is constant over the entire length in the axial-line direction, and therefore a part at which the outer diameter changes is a boundary between the third portion 15 and the second slope portion 19, i.e., a rear end 15*a* of the third portion 15. The outer diameter D is equal to the outer diameter of the boundary between the third portion 15 and the second slope portion 19 (the rear end 15*a* of the third portion 15). The rear end 21 of the second slope portion 19 is located on the inner side of the connection portion 36 of the metal shell 30, and the rear end 15*a* of the third portion 15 is located on the inner side of the seat portion 35 of the metal shell 30.

In the first slope portion 18, the first portion 13, and the second slope portion 19, the sectional area of the axial hole 12 perpendicular to the axial line O is constant. In the insulator 11, a length A in the axial-line direction of the second slope portion 19 and a length B in the axial-line direction of the first slope portion 18 satisfy $2.0 \leq A/B \leq 3.9$. The outer diameter D of the boundary between the third portion 15 and the second slope portion 19 and the outer diameter F of the boundary between the second portion 14 and the first slope portion 18 satisfy $0.50 \leq D/F \leq 0.88$.

When a bending load is applied to the insulator 11, stress concentrates on the first slope portion 18 and the second slope portion 19 where the sectional shapes perpendicular to the axial line O are changed, so that the first slope portion 18 and the second slope portion 19 are likely to become a start point of breakage. More specifically, parts that are likely to become a start point of breakage are the vicinity of the boundary between the first slope portion 18 and the second portion 14, and the vicinity of the boundary between the second slope portion 19 and the third portion 15. The third portion 15 contiguous to the second slope portion 19 is thinner than the second portion 14 contiguous to the first slope portion 18, and therefore, due to tensile stress caused by the bending load, the second slope portion 19 is likely to crack prior to the first slope portion 18. However, when $0.50 \leq D/F \leq 0.88$ is satisfied, $2.05 \leq A/B \leq 3.9$ is satisfied, so that stress in the second slope portion 19 which is likely to become a start point of breakage can be reduced.

Figure 3:
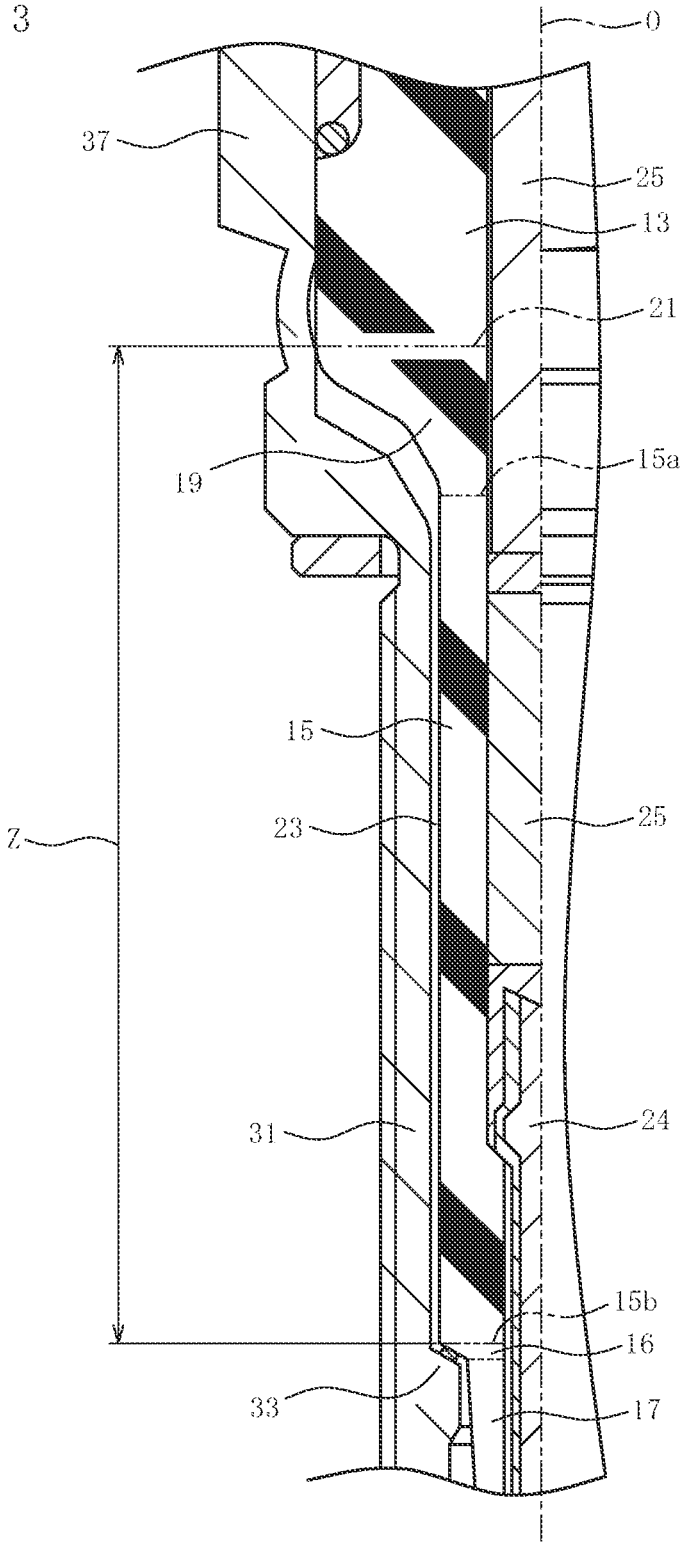
FIG. 3 is an enlarged half-sectional view of a part of the spark plug.

FIG. 3 is an enlarged half-sectional view including the axial line O of a part of the spark plug 10. The diameter reducing portion 16 of the insulator 11 is adjacent to a front end 15*b* of the third portion 15. In a cross section including the axial line O, the front end 15*b* of the third portion 15 is a boundary across which the slope of the outer circumferential surface 23 of the third portion 15 with respect to the axial line O and the slope of the outer circumferential surface of the diameter reducing portion 16 with respect to the axial line O are different. In the present embodiment, in a cross section including the axial line O, the outer circumferential surface 23 of the third portion 15 is parallel to the axial line O. A length Z is the distance in the axial-line direction between the front end 15*b* of the third portion 15 and the rear end 21 of the second slope portion 19. The length Z is equal to a total length of the length in the axial-line direction of the third portion 15 and the length A (see FIG. 2) of the second slope portion 19.

The insulator 11 satisfies $2.2D+7.8 \leq Z \leq 34$ and $4.5 \leq D \leq 8$. D (see FIG. 2) is the outer diameter of the rear end 15*a* of the third portion 15. Thus, the insulator 11 can be even less likely to be broken.

Figure 4:
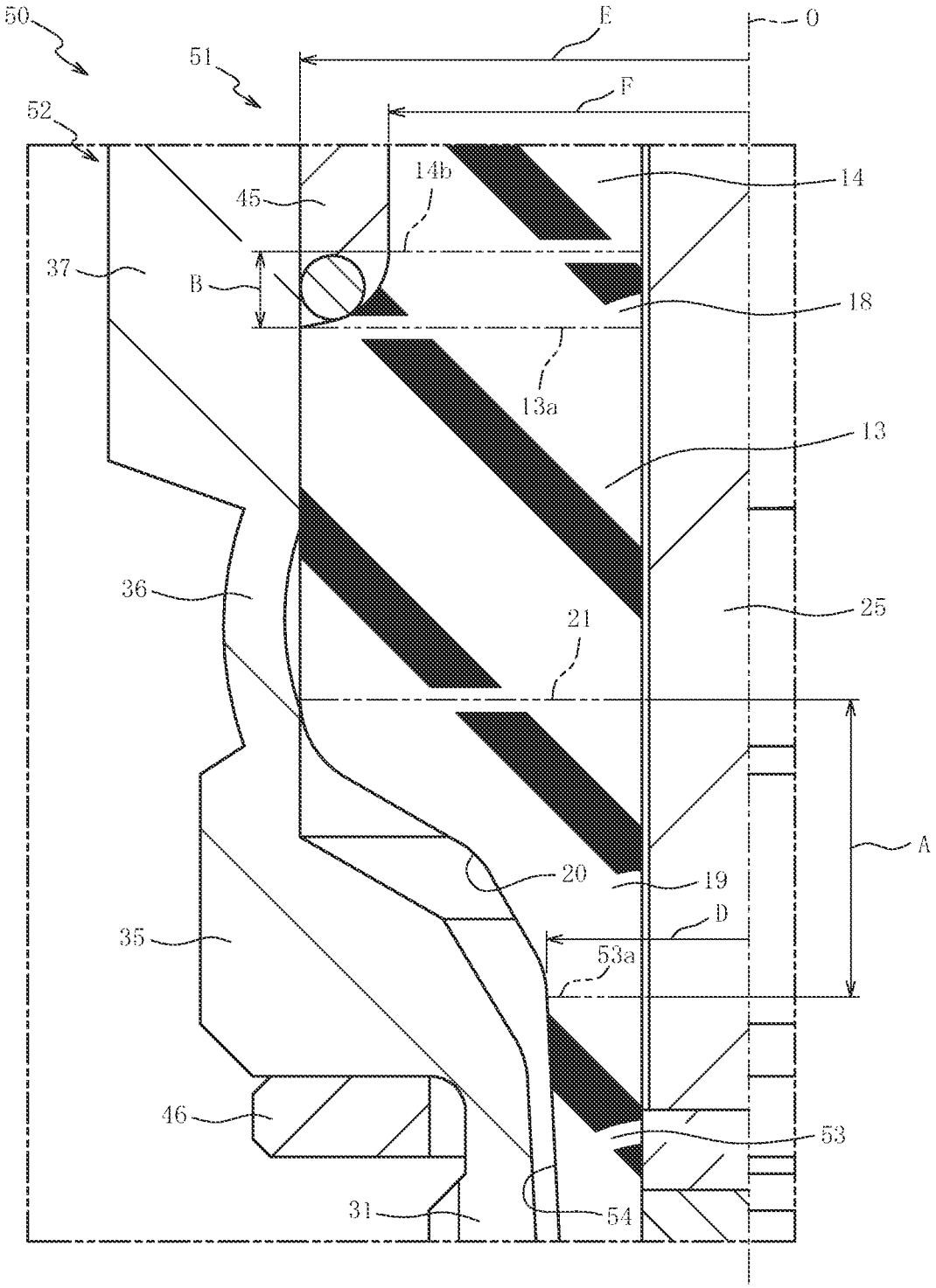
FIG. 4 is an enlarged sectional view of a part of a spark plug according to the second embodiment.

With reference to FIG. 4, the second embodiment will be described. In the first embodiment, the case where the outer diameter of the third portion 15 of the insulator 11 is constant over the entire length in the axial-line direction, has been described. On the other hand, in the second embodiment, the case where the outer diameter of a third portion 53 of an insulator 51 reduces toward the front side will be described. The same parts as those in the first embodiment are denoted by the same reference characters and description thereof will not be repeated below. FIG. 4 is an enlarged sectional view of a part of a spark plug 50 according to the second embodiment. As with the FIG. 2, FIG. 4 is an enlarged view at the part indicated by II in FIG. 1.

The spark plug 50 includes the insulator 51 and a metal shell 52 holding the insulator 51 from the outer circumferential side. In the insulator 51, the second slope portion 19 having an outer diameter that reduces toward the front side connects the third portion 53 and the first portion 13. An outer circumferential surface 54 of the third portion 53 is a conical surface having a diameter that reduces toward the front side. In a cross section including the axial line O, the slope of the outer circumferential surface 54 with respect to the axial line O is constant. The diameter reducing portion 16 of the insulator 51 is adjacent to a front end (not shown) of the third portion 53.

In a cross section including the axial line O, a boundary (a rear end 53*a* of the third portion 53) between the third portion 53 and the second slope portion 19 is a boundary across which the slope of the outer circumferential surface 54 of the third portion 53 with respect to the axial line O and the slope of the outer circumferential surface 20 of the second slope portion 19 with respect to the axial line O are different. The outer diameter D of the rear end 53*a* of the third portion 53 is the outer diameter of the boundary between the third portion 53 and the second slope portion 19. In a cross section including the axial line O, the front end (not shown) of the third portion 53 is a boundary across which the slope of the outer circumferential surface 54 of the third portion 53 with respect to the axial line O and the slope of the outer circumferential surface of the diameter reducing portion 16 with respect to the axial line O are different.

The insulator 51 satisfies $2.0 \leq A/B \leq 3.9$, and satisfies $0.50 \leq D/F \leq 0.88$. The insulator 51 satisfies $2.2D+7.8 \leq Z \leq 34$ and $4.5 \leq D \leq 8$. Thus, the spark plug 50 in the second embodiment also provides the same effects as in the first embodiment.

EXAMPLES

The present invention will be described in more detail with reference to examples. However, the present invention is not limited to the examples.

(Evaluation 1)

Samples 1 to 24 similar to the spark plug 10 according to the first embodiment were manufactured. In samples 1 to 24, various insulators 11 having different dimensions were held by the metal shells 30 having the same dimensions. The insulators 11 of samples 1 to 24 were the same in the entire length in the axial-line direction, the outer diameter E of the first portion 13, and the outer diameter D of the rear end 15*a* of the third portion 15, and different in the length A in the axial-line direction of the second slope portion 19, the length B in the axial-line direction of the first slope portion 18, and the outer diameter F of the front end 14*b* of the second portion 14. Table 1 shows A, B, A/B, D, F, D/F of samples 1 to 24. The outer diameter E of the first portion 13 in samples 1 to 24 was 14 mm. The insulators of the samples were the same in dimensions of parts other than A, B, D, F. In each sample, the size of the seal portion 45 was adjusted and thus the metal shell 30 having the same dimensions was attached to the insulator. For each sample, a plurality of samples having the same dimensions were prepared.

TABLE 1

| No. | A (mm) | B (mm) | A/B | D (mm) | F (mm) | D/F | θ (°) | Crack position |
|---|---|---|---|---|---|---|---|---|
| 1 | 2.00 | 1.05 | 1.9 | 6.0 | 12.0 | 0.50 | 15 | A |
| 2 | 3.80 | 2.00 | 1.9 | 6.0 | 12.0 | 0.50 | 15 | A |
| 3 | 2.00 | 1.00 | 2.0 | 6.0 | 12.0 | 0.50 | 40 | — |
| 4 | 4.00 | 2.00 | 2.0 | 6.0 | 12.0 | 0.50 | 41 | — |
| 5 | 2.00 | 0.51 | 3.9 | 6.0 | 12.0 | 0.50 | 44 | — |
| 6 | 7.80 | 2.00 | 3.9 | 6.0 | 12.0 | 0.50 | 46 | — |
| 7 | 2.00 | 0.50 | 4.0 | 6.0 | 12.0 | 0.50 | 25 | B |

TABLE 1-continued

| No. | A (mm) | B (mm) | A/B | D (mm) | F (mm) | D/F | θ (°) | Crack position |
|---|---|---|---|---|---|---|---|---|
| 8 | 8.00 | 2.00 | 4.0 | 6.0 | 12.0 | 0.50 | 25 | B |
| 9 | 2.00 | 1.05 | 1.9 | 6.0 | 10.3 | 0.58 | 15 | A |
| 10 | 3.80 | 2.00 | 1.9 | 6.0 | 10.3 | 0.58 | 15 | A |
| 11 | 2.00 | 1.00 | 2.0 | 6.0 | 10.3 | 0.58 | 40 | — |
| 12 | 4.00 | 2.00 | 2.0 | 6.0 | 10.3 | 0.58 | 41 | — |
| 13 | 2.00 | 0.51 | 3.9 | 6.0 | 10.3 | 0.58 | 44 | — |
| 14 | 7.80 | 2.00 | 3.9 | 6.0 | 10.3 | 0.58 | 46 | — |
| 15 | 2.00 | 0.50 | 4.0 | 6.0 | 10.3 | 0.58 | 25 | B |
| 16 | 8.00 | 2.00 | 4.0 | 6.0 | 10.3 | 0.58 | 25 | B |
| 17 | 2.00 | 1.05 | 1.9 | 6.0 | 6.8 | 0.88 | 25 | A |
| 18 | 3.80 | 2.00 | 1.9 | 6.0 | 6.8 | 0.88 | 25 | A |
| 19 | 2.00 | 1.00 | 2.0 | 6.0 | 6.8 | 0.88 | 40 | — |
| 20 | 4.00 | 2.00 | 2.0 | 6.0 | 6.8 | 0.88 | 42 | — |
| 21 | 2.00 | 0.51 | 3.9 | 6.0 | 6.8 | 0.88 | 44 | — |
| 22 | 7.80 | 2.00 | 3.9 | 6.0 | 6.8 | 0.88 | 46 | — |
| 23 | 2.00 | 0.50 | 4.0 | 6.0 | 6.8 | 0.88 | 25 | B |
| 24 | 8.00 | 2.00 | 4.0 | 6.0 | 6.8 | 0.88 | 25 | B |

Figure 5:
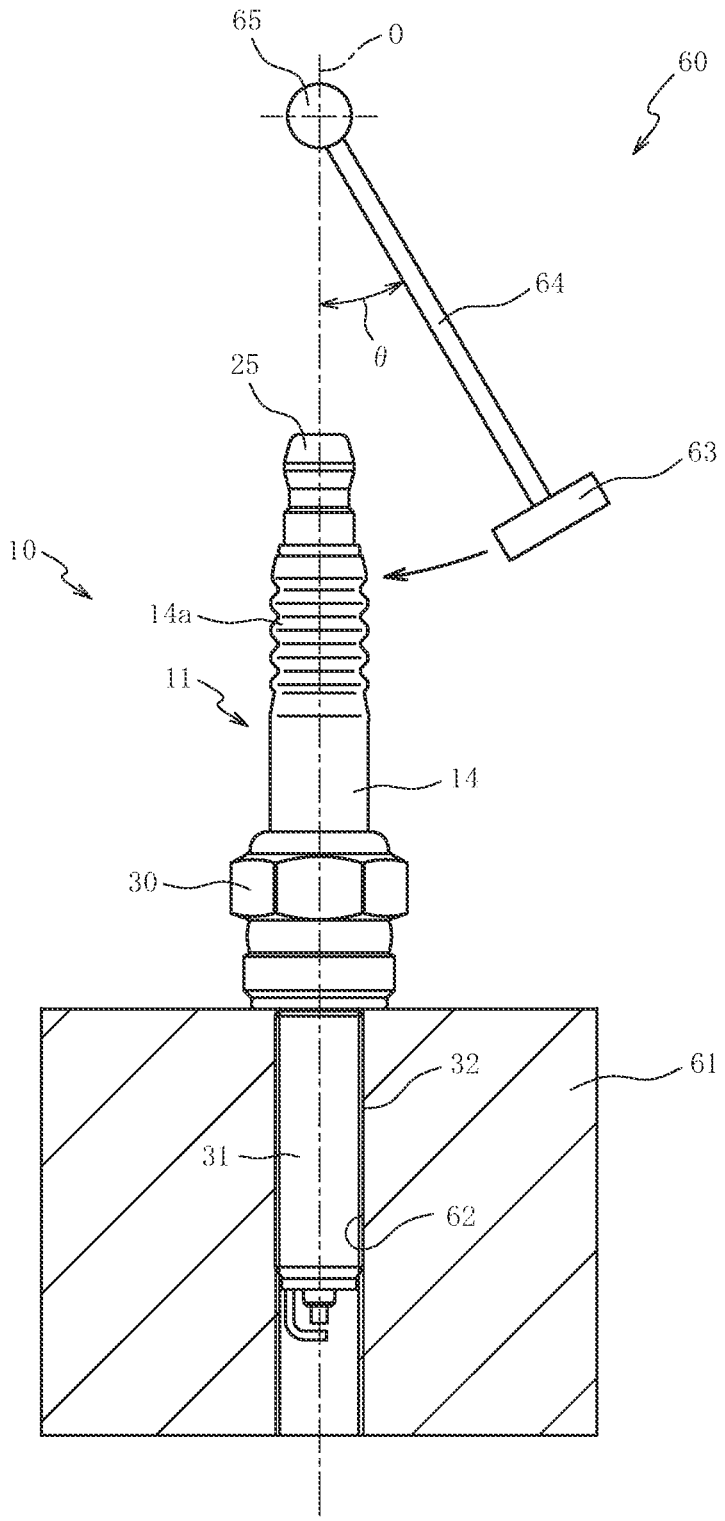
FIG. 5 is a schematic view showing an impact test.

FIG. 5 is a schematic view showing an impact test for evaluating samples 1 to 24. A testing apparatus 60 includes a stand 61 in which a screw hole 62 is formed, and a hammer 63. The external thread 32 of the metal shell 30 in each sample is tightened to the screw hole 62 of the stand 61. When the metal shell 30 in each sample is screwed into the stand 61, the insulator 11 protrudes vertically upward from the stand 61. The length by which the metal shell 30 is screwed into the stand 61 is restricted by the seat portion 35 and the gasket 46 of the metal shell 30. The hammer 63 is made of steel and attached to an arm 64. The arm 64 rotates around a shaft 65 located on the axial line O of the insulator 11. The length of the arm 64 is 330 mm and the mass of the hammer 63 is 1.13 kg.

In the impact test, the hammer 63 was raised by an angle θ with respect to the axial line O, and then the hammer 63 freely fell like a pendulum so that the hammer 63 collided with a first crest from the rear side of the corrugation 14*a* of the insulator 11. Presence/absence of crack in the insulator 11 was checked through penetrant inspection, and the smallest one of the raising angles θ of the hammer 63 when crack occurred in the insulator 11 (intervals of θ were 1°) is written in Table 1.

For the low-strength samples in which the raising angle θ of the hammer 63 was smaller than 30°, the position of crack is written in Table 1. A is written for the samples in which crack occurred near the second slope portion 19, and B is written for the samples in which crack occurred near the first slope portion 18.

As is found from Table 1, among samples 1 to 24 satisfying 0.50≤D/F≤0.88, in samples 1, 2, 9, 10, 17, 18 for A/B<2.0 (A/B=1.9), the bending strength of the insulator 11 was low and crack occurred near the boundary between the second slope portion 19 and the third portion 15 at the raising angle θ<30°. Also in samples 7, 8, 15, 16, 23, 24 for A/B>3.9 (A/B=4.0), the bending strength of the insulator 11 was low and crack occurred near the boundary between the first slope portion 18 and the second portion 14 at the raising angle θ<30°.

However, in samples 3 to 6, 11 to 14, 19 to 22 for 2.0≤A/B≤3.9, the bending strength of the insulator 11 was high and the raising angle was θ≥30°. Thus, it has been found that, when 2.0≤A/B≤3.9 and 0.50≤D/F≤0.88 are satisfied, the bending strengths of the first slope portion 18 and the second slope portion 19 can be ensured and the insulator 11 can be less likely to be broken.

In samples 17 to 24 for D/F=0.88, the raising angle θ for A/B=1.9 (samples 17, 18) was 25°, and the raising angle θ for 2.0≤A/B≤3.9 (samples 19 to 22) was 40° to 46°. The difference between the angle θ for A/B=1.9 and the angle θ for 2.0≤A/B≤3.9 was 15 to 21°.

On the other hand, in samples 1 to 16 for 0.50≤D/F≤0.58, the raising angle θ for A/B=1.9 (samples 1, 2, 9, 10) was 15°, and the raising angle θ for 2.0≤A/B≤3.9 (samples 3 to 6, 11 to 14) was 40° to 46°. The difference between the angle θ for A/B=1.9 and the angle θ for 2.0≤A/B≤3.9 was 25 to 31°.

From the above result, it has been found that, in samples 1 to 16 for 0.50≤D/F≤0.58, the difference between the angle θ for A/B=1.9 and the angle θ for 2.0≤A/B≤3.9 can be increased as compared to samples 17 to 24 for D/F=0.88. That is, it has been found that, in the case of 0.50≤D/F≤0.58, the second slope portion 19 becomes less likely to crack when 2.0≤A/B≤3.9 is satisfied. Accordingly, it has been found that, when 0.50≤D/F≤0.58 is satisfied, the second slope portion 19 is reduced in strength and becomes likely to crack, but if 2.0≤A/B≤3.9 is satisfied, stress in the second slope portion 19 is reduced and crack of the second slope portion 19 can be significantly inhibited.

In this test, samples 1 to 24 were set at D=6.0 mm. However, the insulator 11 can be set in a range of 4.5≤D≤10.0 mm, for example. Similarly, the insulator 11 can be set in ranges of 2.00≤A≤7.80 mm, 0.51≤B≤2.0 mm, and 6.8≤F≤12.0 mm.

(Evaluation 2)

In the impact test shown in FIG. 5, each sample is a so-called cantilever beam with one end fixed to the stand 61. Deflection of the cantilever beam is proportional to the cube of the beam length and inversely proportional to the second moment of area of the beam.

As shown in Table 1, in the samples for A/B=1.9, crack occurred near the second slope portion 19. Since the diameter reducing portion 16 of the insulator 11 is supported by the ledge portion 33 of the metal shell 30, the length Z from the second slope portion 19 where crack occurred to the front end 15*b* of the third portion 15 adjacent to the diameter reducing portion 16 is assumed to be the beam length. Since the proportion of the length of the third portion 15 in the length Z is greater than the proportion of the length A of the second slope portion 19, the second moment of area of the third portion 15 is assumed to be the second moment of area of the beam. In this case, deflection of the cantilever beam is proportional to the cube of the length Z and inversely proportional to the fourth power of the outer diameter D of the third portion 15. The smaller the deflection is, the less the cantilever beam is likely to be broken. Therefore, the smaller the value Z is, the less the insulator 11 is likely to be broken, and the greater the value D is, the less the insulator 11 is likely to be broken.

Figure 6:
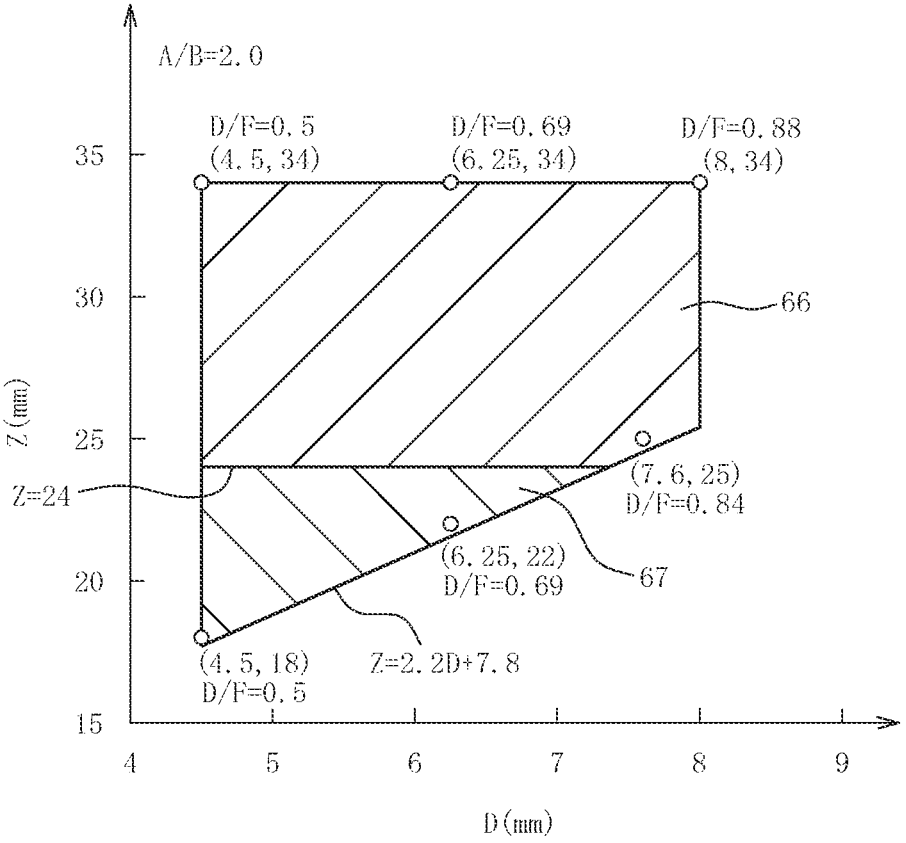
FIG. 6 shows the results of the impact test on samples for A/B=2.0.
Figure 7:
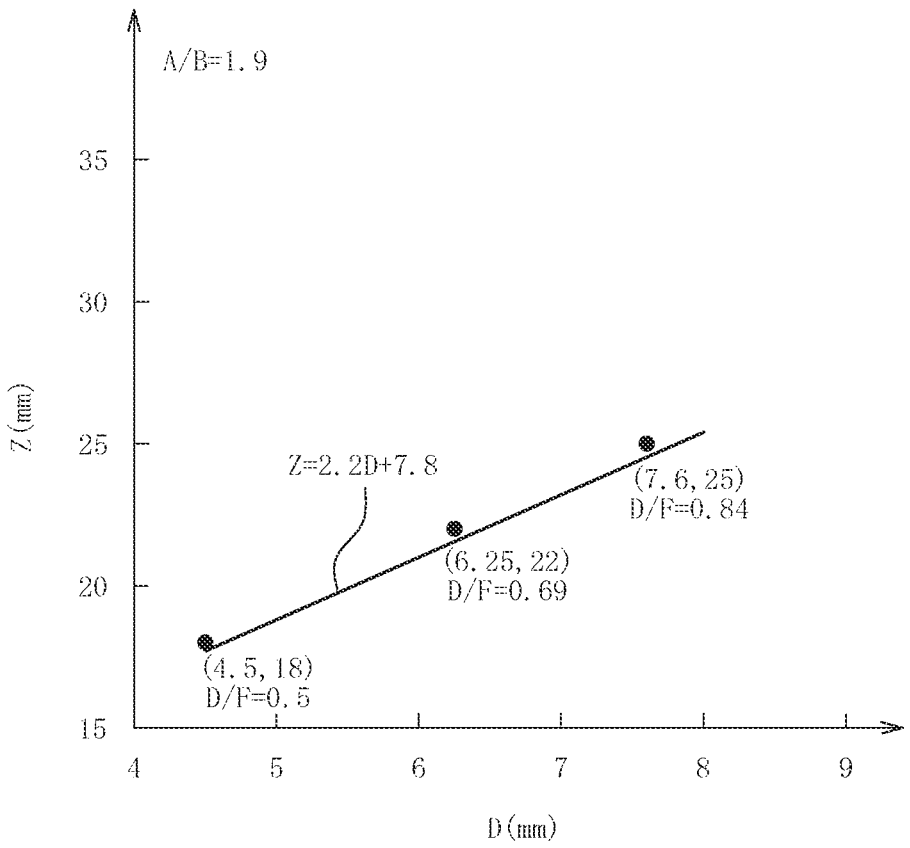
FIG. 7 shows the results of the impact test on samples for A/B=1.9.

In order to find the relationship between A/B, D, and Z of the insulator 11 and breakage of the insulator 11, various samples different in A/B, D, and Z were manufactured in the same manner as in Evaluation 1, and the same impact test as in Evaluation 1 was conducted. FIG. 6 shows a result of the impact test on the samples for A/B=2.0. FIG. 7 shows a result of the impact test on the samples for A/B=1.9.

In FIG. 6 and FIG. 7, the horizontal axis indicates D (mm) and the vertical axis indicates Z (mm). The coordinates indicate D and Z of each sample. In FIG. 6, an area 66 is an area in which 4.5≤D≤8, 24≤Z≤34, and Z≤2.2D+7.8 overlap each other. An area 67 is an area in which D≥4.5, Z≤24, and Z≥2.2D+7.8 overlap each other. White circles in FIG. 6 indicate that the smallest one of the raising angles θ of the hammer 63 when crack occurred in the insulator 11 (intervals of θ were 1°) was 30° or greater. Black circles in FIG. 7 indicate that the raising angle θ was smaller than 30°.

As shown in FIG. 6, at A/B=2.0, the raising angle θ for the samples included in the areas 66, 67 was 30° or greater. Meanwhile, as shown in FIG. 7, at A/B=1.9, the raising angle θ for the samples satisfying Z≥2.2D+7.8 was smaller than 30°. It is obvious from Table 1 that crack in the second slope portion 19 can be inhibited when 2.0≤A/B≤4.0 is satisfied. Thus, it has been found that Z=2.2D+7.8 is the borderline of cracking. Therefore, it has been found that, in the samples included in the areas 66, 67 in which 2.0≤A/B≤3.9, 0.50≤D/F≤0.88, 2.2D+7.8≤Z≤34, and 4.5≤D≤8 are satisfied, the insulator 11 is less likely to be broken.

(Evaluation 3)

Various samples 25 to 48 were manufactured in the same manner as in Evaluation 1, and the same impact test as in Evaluation 1 was conducted (see FIG. 5). Table 2 shows D/F, A/B, Z and the smallest one of the raising angles θ of the hammer 63 when crack occurred in the insulator 11 (intervals of θ were 1°), for samples 25 to 48. In samples 25 to 48, the outer diameter E of the first portion 13 was 14 mm. The insulators of the samples were the same in dimensions of parts other than A, B, D, F, Z.

TABLE 2

| No. | D/F | A/B | Z (mm) | θ (°) | Ratio |
|---|---|---|---|---|---|
| 25 | 0.84 | 2.0 | 23 | 42 | 1.6 |
| 26 | 0.84 | 2.0 | 28 | 40 | 1.7 |
| 27 | 0.84 | 2.0 | 32 | 38 | 1.8 |
| 28 | 0.84 | 2.0 | 34 | 35 | 1.8 |
| 29 | 0.84 | 1.9 | 23 | 25 | — |
| 30 | 0.84 | 1.9 | 28 | 23 | — |
| 31 | 0,84 | 1.9 | 32 | 21 | — |
| 32 | 0.84 | 1.9 | 34 | 19 | — |
| 33 | 0.69 | 2.0 | 23 | 38 | 1,6 |
| 34 | 0.69 | 2.0 | 28 | 36 | 1.6 |
| 35 | 0.69 | 2.0 | 32 | 35 | 1.7 |
| 36 | 0.69 | 2.0 | 34 | 35 | 1.8 |
| 37 | 0.69 | 1.9 | 23 | 23 | — |
| 38 | 0.69 | 1.9 | 28 | 22 | — |
| 39 | 0.69 | 1.9 | 32 | 20 | — |
| 40 | 0.69 | 1.9 | 34 | 19 | — |
| 41 | 0.50 | 2.0 | 23 | 33 | 1.6 |
| 42 | 0.50 | 2.0 | 28 | 33 | 1,8 |
| 43 | 0.50 | 2.0 | 32 | 30 | 1.9 |
| 44 | 0.50 | 2.0 | 34 | 30 | 1.9 |
| 45 | 0.50 | 1.9 | 23 | 20 | — |
| 46 | 0.50 | 1.9 | 28 | 18 | — |
| 47 | 0.50 | 1.9 | 32 | 16 | — |
| 48 | 0.50 | 1.9 | 34 | 16 | — |

In samples 25 to 32, the insulator was placed inside the metal shell 30 in which the nominal diameter of the external thread 32 was 12 mm. In samples 33 to 40, the insulator 11 was placed inside the metal shell 30 in which the nominal diameter of the external thread 32 was 10 mm. In samples 41 to 48, the insulator 11 was placed inside the metal shell 30 in which the nominal diameter of the external thread 32 was 8 mm. In accordance with the inner diameter of the trunk portion 31 of the metal shell 30, the outer diameter D of the third portion 15 in each sample was adjusted, and the outer diameter of the second portion 14 was adjusted.

In samples 25 to 28, 33 to 36, 41 to 44 satisfying A/B=2.0 and 0.50≤D/F≤0.84, the bending strength of the insulator 11 was high and the raising angle was θ≥30°. Meanwhile, in sample 29 to 32, 37 to 40, 45 to 48 satisfying A/B=1.9 and 0.50≤D/F≤0.84, the bending strength of the insulator 11 was low and the raising angle was θ<30°.

In the samples that are the same in D/F and Z and different in A/B (e.g., samples 25 and 29), the ratio of the raising angle θ of the sample for A/B=2.0 to the raising angle θ of the sample for A/B=1.9 (see Table 2) was 1.6 at Z=23 mm, and was 1.6 to 1.9 in a range of 23<Z≤34 (mm).

From the above result, it has been found that, in samples 26 to 28, 34 to 36, 42 to 44 satisfying A/B=2.0 and 23<Z≤34 (mm), as compared to samples 29 to 32, 37 to 40, 45 to 48 for A/B=1.9, the ratio of the angle θ for A/B=2.0 to the angle θ for A/B=1.9 can be made greater than 1. That is, in the case of 24≤Z≤34 (mm), when A/B=2.0 is satisfied, the second slope portion 19 becomes less likely to crack.

It is obvious from Table 1 that crack of the second slope portion 19 can be inhibited when 2.0≤A/B≤4.0 is satisfied. Therefore, it has been found that, in the samples included in the area 66 (see FIG. 6) in which 2.0≤A/B≤3.9, 0.50≤D/F≤0.88, 2.2D+7.8≤Z≤34, 4.5≤D≤8, and Z≥24 are satisfied, the insulator 11 is further less likely to crack.

While the present invention has been described above with reference to the embodiments, the present invention is not limited to the above embodiments at all. It can be easily understood that various modifications can be devised without departing from the gist of the present invention.

In the above embodiments, the spark plug 10 with the gasket 45 provided in the metal shell 30 has been described. However, the present invention is not necessarily limited thereto. In the case where the spark plug 10 is a conical seal type (taper sheet type), the gasket 45 can be omitted.

In the above embodiments, the case where the center electrode 24 and the metal terminal 25 are electrically connected via the resistor 26 in the axial hole 12 of the insulator 11, has been described. However, the present invention is not necessarily limited thereto. As a matter of course, the center electrode 24 and the metal terminal 25 may be electrically connected in the axial hole 12 of the insulator 11 without providing the resistor 26.

In the above embodiments, the case where the seal portion 45 is interposed between the first portion 13 of the insulator 11 and the rear end portion 38 of the metal shell 30, has been described. However, the present invention is not necessarily limited thereto. As a matter of course, the rear end portion 38 of the metal shell 30 may be crimped and fixed to the first portion 13 of the insulator 11 without providing the seal portion 45.

In the above embodiments, the case where the resistor 26 electrically connecting the center electrode 24 and the metal terminal 25 is provided in the axial hole 12 of the insulator 11, has been described. However, the present invention is not necessarily limited thereto. As a matter of course, the metal terminal 25 may be connected to the center electrode 24 via a conductor without providing the resistor 26.

DESCRIPTION OF REFERENCE NUMERALS

10, 50: spark plug
11, 51: insulator
12: axial hole
13: first portion
14: second portion
**14*b***: front end of second portion
15, 53: third portion
**15*a*, 53*a***: rear end of third portion
16: diameter reducing portion
18: first slope portion
19: second slope portion
30: metal shell
32: external thread

33: ledge portion
A: length of second slope portion
B: length of first slope portion
D: outer diameter of rear end of third portion
E: outer diameter of first portion
F: outer diameter of front end of second portion
Z: total length of length of third portion and length of second slope portion
O: axial line

What is claimed is:

1. A spark plug comprising an insulator in which an axial hole extending along an axial line from a front side to a rear side is formed, wherein the insulator includes a cylindrical first portion, a cylindrical second portion located on the rear side of the first portion, an outer diameter F at a front end of the second portion being smaller than an outer diameter of the first portion, a cylindrical third portion located on the front side of the first portion, an outer diameter D at a rear end of the third portion being smaller than the outer diameter of the first portion and the outer diameter F at the front end of the second portion, a first slope portion connecting the first portion and the second portion, and having an outer diameter that reduces toward the rear side, and a second slope portion connecting the first portion and the third portion, and having an outer diameter that reduces toward the front side, and a length A in an axial-line direction of the second slope portion and a length B in the axial-line direction of the first slope portion satisfy $2.0 \leq A/B \leq 3.9$, and $0.50 \leq D/F \leq 0.88$ is satisfied.

2. The spark plug according to claim 1, wherein $0.5 \leq D/F \leq 0.58$ is satisfied.

3. The spark plug according to claim 1, further comprising a metal shell provided around an outer circumference of the insulator, wherein the insulator includes a diameter reducing portion adjacent to a front end of the third portion, the metal shell includes a ledge portion engaging with the diameter reducing portion from the front side, and $2.2D+7.8 \leq Z \leq 34$ and $4.5 \leq D \leq 8$ are satisfied, where Z is a total length of a length in the axial-line direction of the third portion and the length A in the axial-line direction of the second slope portion.

4. The spark plug according to claim 3, wherein $24 \leq Z \leq 34$ is satisfied.

5. The spark plug according to claim 1, further comprising a metal shell provided around an outer circumference of the insulator, wherein the metal shell has an external thread formed on an outer circumference thereof, and a nominal diameter of the external thread is not greater than 12 mm.

* * * * *